US011779986B2

(12) United States Patent
Zhang et al.

(10) Patent No.: US 11,779,986 B2
(45) Date of Patent: Oct. 10, 2023

(54) HOT-SPINNING FORMATION METHOD FOR LARGE-DIAMETER TITANIUM ALLOY CYLINDRICAL PARTS

(71) Applicant: Xi'an Taijin New Energy & Materials Sci-Tech Co., Ltd., Xi'an (CN)

(72) Inventors: Le Zhang, Xi'an (CN); Qing Feng, Xi'an (CN); Chu Shen, Xi'an (CN); Xiuling He, Xi'an (CN); Bo Yang, Xi'an (CN); Dong Miao, Xi'an (CN); Yaohui Li, Xi'an (CN)

( * ) Notice: Subject to any disclaimer, the term of this patent is extended or adjusted under 35 U.S.C. 154(b) by 0 days.

(21) Appl. No.: 18/058,847

(22) Filed: Nov. 25, 2022

(65) Prior Publication Data

US 2023/0166312 A1 Jun. 1, 2023

(30) Foreign Application Priority Data

Nov. 26, 2021 (CN) ..... 202111420387.2

(51) Int. Cl.

| | |
|---|---|
| ***B21D 22/16*** | (2006.01) |
| ***B21D 37/16*** | (2006.01) |
| ***B21D 37/01*** | (2006.01) |
| ***B21D 51/10*** | (2006.01) |

(52) U.S. Cl.

CPC ..... *B21D 22/16* (2013.01); *B21D 37/01* (2013.01); *B21D 37/16* (2013.01); *B21D 51/10* (2013.01)

(58) Field of Classification Search

CPC ..... B21D 22/16; B21D 22/14; B21D 51/10; B21D 37/16

See application file for complete search history.

(56) References Cited

FOREIGN PATENT DOCUMENTS

| | | | | | |
|---|---|---|---|---|---|
| CN | 101704035 A | | 5/2010 | | |
| CN | 104624766 A | * | 5/2015 | ..... | B21D 22/16 |
| CN | 106944494 A | * | 7/2017 | ..... | B21D 22/14 |
| CN | 109465321 A | | 3/2019 | | |
| CN | 213256671 U | | 5/2021 | | |
| JP | 58110137 A | * | 6/1983 | ..... | B21D 22/16 |

OTHER PUBLICATIONS

Araki, Translation of JP-58110137-A (Year: 1983).*
Hou, Translation of CN-104624766-A (Year: 2015).*
Wan, Translation of CN-106944494-A (Year: 2017).*

* cited by examiner

*Primary Examiner* — Bobby Yeonjin Kim
(74) *Attorney, Agent, or Firm* — Novoclaims Patent Services LLC; Mei Lin Wong

(57) ABSTRACT

A hot-spinning formation method for large-diameter titanium alloy cylindrical parts. A workblank is placed in a resistance furnace to heated to 600-650° C., is maintained at this temperature for 0.5-1 h and is then taken out of the resistance furnace; after the workblank is heated, the inner diameter of the workblank becomes larger; the heated workblank is installed on a mandrel, and spinning is started when a maximum clearance between the workblank and the mandrel is less than 0.5 mm; the mandrel and the spinning rollers do not need to be preheated, and a multi-pass spinning process is adopted, such that the workblank can deform more uniformly. A vertical spinning lathe is used for spinning, the mandrel is easy to change, and the workblank is easy to assemble and disassemble.

7 Claims, 1 Drawing Sheet

HOT-SPINNING FORMATION METHOD FOR LARGE-DIAMETER TITANIUM ALLOY CYLINDRICAL PARTS

CROSS REFERENCE OF RELATED APPLICATION

This is a non-provisional application that claims priority to a Chinese application, application number CN2021114203872, filed on Nov. 26, 2021, the entire contents of which is expressly incorporated herein by reference.

BACKGROUND OF THE PRESENT INVENTION

Field of Invention

The invention belongs to the technical field of plastic formation of titanium cylindrical parts, and relates to a hot-spinning formation method for large-diameter titanium alloy cylindrical parts.

BACKGROUND OF THE INVENTION

Description of Related Arts

Titanium alloy is widely used for making various cylindrical parts in the fields of aviation, airspace, ships and weapons because of its high specific strength and good corrosion resistance and welding performance. Hot-spinning formation is a little-cutting or no-cutting machining process integrating the characteristics of the forging process, the stretching process, the extruding process and the rolling process, has the advantages of high utilization rate of materials and good performance of products, and can produce seamless hollow rotary parts.

Due to the poor plasticity, high strength, low heat conductivity and poor cutting performance of titanium alloy at room temperature, parts machined from titanium alloy through cold spinning are likely to crack, and particularly, large-diameter cylindrical parts made of titanium alloy are more likely to crack during spinning. In addition, during the hot-spinning process, the edge of existing titanium alloy cylindrical parts may curl, and the diameter of the titanium alloy cylindrical parts may be out of tolerance, leading to poor straightness and roundness of the cylindrical parts.

SUMMARY OF THE PRESENT INVENTION

The objective of the invention is to overcome the defects of the prior art by providing a hot-spinning formation method for large-diameter titanium alloy cylindrical parts, to obtain titanium alloy cylindrical parts with good straightness and roundness.

To fulfill the above objective, the invention provides the following technical solution:

According to the hot-spinning formation method for large-diameter titanium alloy cylindrical parts, a to-be-machined workblank is placed in a resistance furnace to be heated to 600-650° C., and is taken out of the resistance furnace after being maintained at this temperature for 0.5-1 h; the heated workblank is disposed around a mandrel, and spinning is started when a maximum clearance between the workblank and the mandrel is less than 0.5 mm; after the spinning is ended, the workblank is lifted by a pneumatic jack cylinder to be removed from the mandrel, and when lifted to a designated position, the workblank is completely removed from the mandrel, such that a titanium alloy cylindrical part is obtained.

Further, the hot-spinning formation method for large-diameter titanium alloy cylindrical parts specifically comprises the following steps:

Step 1: installing the mandrel on a spinning lathe workbench;

Step 2: starting the pneumatic jack cylinder, and enabling the pneumatic jack cylinder to return to a working position;

Step 3: placing the workblank in the resistance furnace, heating the workblank in the resistance furnace to 600-650° C., maintaining the workblank at this temperature for 0.5-1 h, and then taking the workblank out of the resistance furnace;

Step 4: disposing the heated workblank, which is discharged out of the resistance furnace, around the mandrel, and clamping a lower end of the workblank in a groove in the pneumatic jack cylinder;

Step 5: when the heated workblank shrinks to clamp the mandrel, starting spinning, and during the spinning process, enabling spinning rollers to move downwards;

Step 6: according to different passes of the spinning, repeating Step 5 in each pass of the spinning; and Step 7: when the spinning is ended, lifting, by the pneumatic jack cylinder, the workblank to be removed from the mandrel, and when the workblank is lifted to the designated position, completely removing the workblank from the mandrel, such that the titanium alloy cylindrical part is obtained.

Further, a rotational speed of the mandrel is 20-40 rad/min, a feed ratio is 2-4 mm/rad, and a reduction of each pass is 4-8 mm.

Further, an outer diameter of the workblank is not less than 3 m.

Further, the mandrel and the spinning rollers do not need to be preheated in advance.

Further, the workblank is in transitional fit with the mandrel, and a clearance between the workblank and the mandrel is less than or equal to 0.5 mm.

Further, the number of the spinning rollers is two, and the two spinning rollers are distributed on the spinning lathe workbench in a bilaterally symmetrical manner.

Optionally, the number of the spinning rollers is an even number greater than four, every two of the spinning rollers are in a group, and the two spinning rollers in each group are symmetrically distributed on the spinning lathe workbench; the spinning rollers, located on the same side, in the adjacent groups are distributed in a vertically staggered manner.

Further, a surface of the mandrel is coated with a layer of molybdenum disulfide oil, water-based graphite, or a glass lubricating protectant.

Further, lifting rings which are easy to assemble and disassemble are disposed at a top end of the mandrel.

Further, the mandrel is made of H13 hot work die steel, K403 high-temperature alloy, or 4Cr5MoSiV1.

Further, the spinning rollers are made of H13 hot work die steel, W18Cr4V high-speed steel, or 4Cr5MoSiV1.

Compared with the prior art, the technical solution provided by the invention has the following beneficial effects: the workblank is placed in the resistance furnace to heated to 600-650° C., is maintained at this temperature for 0.5-1 h, and is then taken out of the resistance furnace; after the workblank is heated, the inner diameter of the workblank becomes larger (the original inner diameter of the workblank is slightly greater than the outer diameter of the mandrel); the heated workblank is installed on the mandrel, and spinning is started when the maximum clearance between the workblank and the mandrel is less than 0.5 mm; the mandrel and the spinning rollers do not need to be preheated, and a multi-pass spinning process is adopted, such that the workblank can deform more uniformly. A vertical spinning lathe is used for spinning, the mandrel is easy to change, and the workblank is easy to assemble and disassemble; and the hot-spinning formation method can be used for hot-spinning formation of titanium alloy cylindrical parts with an outer diameter over 3 m, the obtained cylindrical parts have good straightness and roundness, and the yield is high.

Here, it should be noted that, because the recrystallization temperature of industrially pure titanium is 550-650° C., in order to ensure that the workblank has certain plasticity during the spinning process, recrystallization annealing should be performed on the workblank before spinning to properly reduce the strength of the workblank, so as to prevent the workblank again cracks caused by excessively high strength during the spinning process; and in the invention, the recrystallization annealing temperature is 600-650° C., and the annealing time is 0.5-1 h (the recrystallization annealing time should not be too long, which may otherwise cause coarse grains of the workblank).

Figure 1:
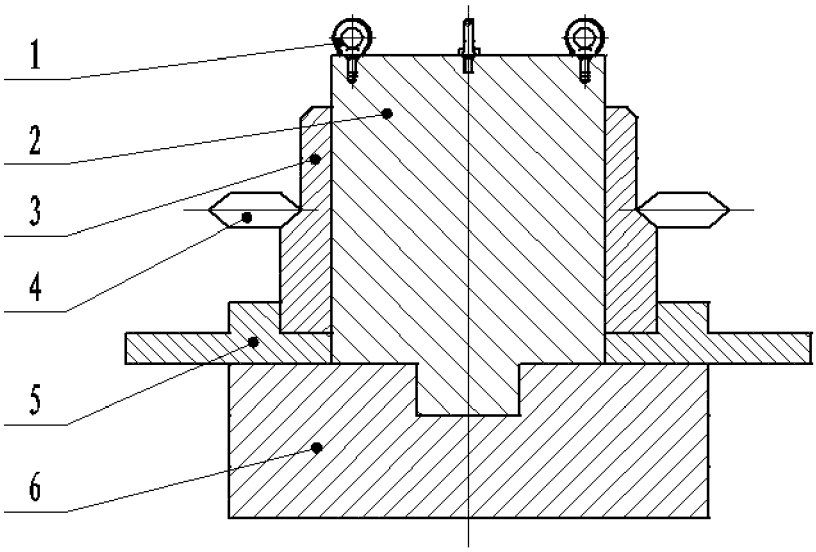
FIG. 1 is a structural diagram of a spin forming table provided by the invention.
Figure 2:
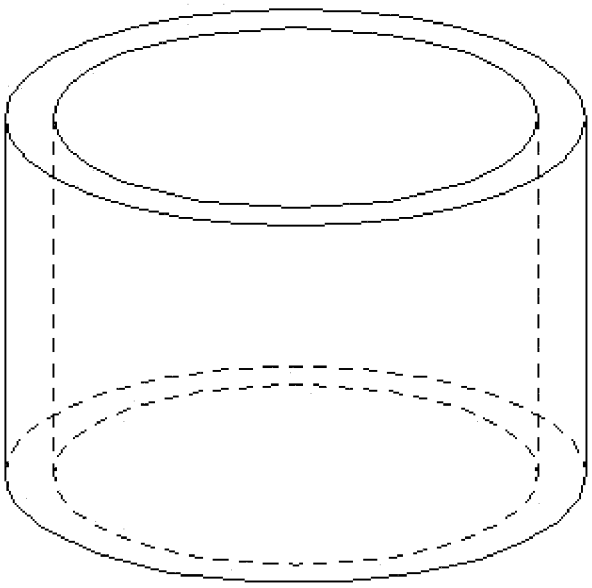
FIG. 2 is a structural diagram of a large-diameter titanium alloy cylindrical part provided by the invention.

Reference signs: 1, lifting ring; 2, mandrel; 3, workblank; 4, spinning roller; 5, pneumatic jack cylinder; 6, spinning lathe workbench.

DETAILED DESCRIPTION OF THE PREFERRED EMBODIMENT

Illustrative embodiments of the invention will be described in detail here, and the implementations described in the following illustrative embodiments are not all possible ones of the invention. They are merely examples of the method, which are consistent with some aspects of the invention detailed in the appended claims.

To allow those skilled in the art to gain a better understanding of the technical solutions of the invention, the invention will be described in further detail below in conjunction with the accompanying drawings and embodiments.

Embodiment 1

This embodiment provides a hot-spinning formation method for large-diameter titanium alloy cylindrical parts, which specifically comprises the following steps:

Step 1: a mandrel 2 is installed and fixed on a spinning lathe workbench 6 by lifting through lifting rings 1, and after the mandrel 2 is installed, an outer surface of the mandrel 2 is coated with a layer of molybdenum disulfide oil, wherein the mandrel 2 is made of H13 hot work die steel, and the diameter of the mandrel 2 is 2650 mm.

Step 2: a pneumatic jack cylinder 5 is started to return to a working position.

Step 3: a workblank 3 is placed in a resistance furnace to be heated to 650° C., is maintained at this temperature for 0.5 h, and is then discharged out of the resistance furnace.

Step 4: the heated workblank 3 discharged out of the resistance furnace is disposed around the mandrel 2 by lifting, and a lower end of the workblank 3 is clamped in a groove of the pneumatic jack cylinder 5, wherein the workblank 3 is made of TA1, and has an outer diameter of 2770 mm, a wall thickness of 60 mm and a height of 1000 mm.

Step 5: when the workblank 3 shrinks to a degree that a maximum clearance between the workblank 3 and the mandrel 2 is 0.5 mm, spinning is started, and during the spinning process, spinning rollers 4 move downwards, wherein the spinning rollers 4 are made of 4Cr5MoSiV1, and a rotational speed of the mandrel 2 is 20 rad/min.

Step 6: five-pass spinning is adopted, and Step 5 is repeated in each pass, wherein the reduction of the first pass is 8 mm, the feed rate of the first pass is 40 mm/min, and the feed ratio of the first pass is 2 mm/rad; the reduction of the second pass is 6.5 mm, the feed rate of the second pass is 50 mm/min, and the feed ratio of the second pass is 2.5 mm/rad; the reduction of the third pass is 6 mm, the feed rate of the third pass is 60 mm/min, and the feed ratio of the third pass is 3 mm/rad; the reduction of the fourth pass is 5.5 mm, the feed rate of the fourth pass is 70 mm/min, and the feed ratio of the fourth pass is 3.5 mm/rad; the reduction of the fifth pass is 4 mm, the feed rate of the fifth pass is 80 mm/min, and the feed ratio of the fifth pass is 4 mm/rad;

Step 7: after the spinning is ended, the workblank 3 is lifted by the pneumatic jack cylinder 5 to be removed from the mandrel; when lifted to an appropriate position, the workblank 3 is completely removed from the mandrel, wherein a cylindrical part formed by spinning has an outer diameter of 2710 mm and a wall thickness of 30 mm.

Embodiment 2

This embodiment provides another hot-spinning formation method for large-diameter titanium alloy cylindrical parts, which specifically comprises the following steps:

Step 1: a mandrel 2 is installed and fixed on a spinning lathe workbench 6 by lifting through lifting rings 1, and after the mandrel 2 is installed, an outer surface of the mandrel 2 is coated with a layer of molybdenum disulfide oil, wherein the mandrel 2 is made of H13 hot work die steel, and the diameter of the mandrel 2 is 2650 mm.

Step 2: a pneumatic jack cylinder 5 is started to return to a working position.

Step 3: a workblank 3 is placed in a resistance furnace to be heated to 600° C., is maintained at this temperature for 1 h, and is then discharged out of the resistance furnace.

Step 4: the heated workblank 3 discharged out of the resistance furnace is disposed around the mandrel 2 by lifting, and a lower end of the workblank 3 is clamped in a groove of the pneumatic jack cylinder 5, wherein the workblank 3 is made of TA1, and has an outer diameter of 2770 mm, a wall thickness of 60 mm and a height of 1000 mm.

Step 5: when the workblank 3 shrinks to a degree that a maximum clearance between the workblank 3 and the mandrel 2 is 0.5 mm, spinning is started, and during the spinning process, spinning rollers 4 move downwards, wherein the spinning rollers 4 are made of 4Cr5MoSiV1, and a rotational speed of the mandrel 2 is 30 rad/min.

Step 6: five-pass spinning is adopted, and Step 5 is repeated in each pass, wherein the reduction of the first pass is 7.5 mm, the feed rate of the first pass is 45 mm/min, and the feed ratio of the first pass is 1.5 mm/rad; the reduction of the second pass is 7 mm, the feed rate of the second pass is 60 mm/min, and the feed ratio of the second pass is 2 mm/rad; the reduction of the third pass is 6 mm, the feed rate of the third pass is 69 mm/min, and the feed ratio of the third pass is 2.3 mm/rad; the reduction of the fourth pass is 5.5 mm, the feed rate of the fourth pass is 75 mm/min, and the feed ratio of the fourth pass is 2.5 mm/rad; the reduction of the fifth pass is 4 mm, the feed rate of the fifth pass is 90 mm/min, and the feed ratio of the fifth pass is 3 mm/rad;

Step 7: after the spinning is ended, the workblank 3 is lifted by the pneumatic jack cylinder 5 to be removed from the mandrel; when lifted to an appropriate position, the workblank 3 is completely removed from the mandrel, wherein a cylindrical part formed by spinning has an outer diameter of 2710 mm and a wall thickness of 30 mm.

Embodiment 3

This embodiment provides another hot-spinning formation method for large-diameter titanium alloy cylindrical parts, which specifically comprises the following steps:

Step 1: a mandrel 2 is installed and fixed on a spinning lathe workbench 6 by lifting through lifting rings 1, and after the mandrel 2 is installed, an outer surface of the mandrel 2 is coated with a layer of molybdenum disulfide oil, wherein the mandrel 2 is made of H13 hot work die steel, and the diameter of the mandrel 2 is 2950 mm.

Step 2: a pneumatic jack cylinder 5 is started to return to a working position.

Step 3: a workblank 3 is placed in a resistance furnace to be heated to 650° C., is maintained at this temperature for 0.5 h, and is then discharged out of the resistance furnace.

Step 4: the heated workblank 3 discharged out of the resistance furnace is disposed around the mandrel 2 by lifting, and a lower end of the workblank 3 is clamped in a groove of the pneumatic jack cylinder 5, wherein the workblank 3 is made of TA1, and has an outer diameter of 3010 mm, a wall thickness of 60 mm and a height of 1000 mm.

Step 5: when the workblank 3 contracts to a degree that a maximum clearance between the workblank 3 and the mandrel 2 is 0.5 mm, spinning is started, and during the spinning process, spinning rollers 4 move downwards, wherein the spinning rollers 4 are made of 4Cr5MoSiV1, and a rotational speed of the mandrel 2 is 20 rad/min.

Step 6: five-pass spinning is adopted, and Step 5 is repeated in each pass, wherein the reduction of the first pass is 7.5 mm, the feed rate of the first pass is 40 mm/min, and the feed ratio of the first pass is 2 mm/rad; the reduction of the second pass is 6.5 mm, the feed rate of the second pass is 50 mm/min, and the feed ratio of the second pass is 2.5 mm/rad; the reduction of the third pass is 6 mm, the feed rate of the third pass is 60 mm/min, and the feed ratio of the third pass is 3 mm/rad; the reduction of the fourth pass is 5.5 mm, the feed rate of the fourth pass is 70 mm/min, and the feed ratio of the fourth pass is 3.5 mm/rad; the reduction of the fifth pass is 4.5 mm, the feed rate of the fifth pass is 80 mm/min, and the feed ratio of the fifth pass is 4 mm/rad.

Step 7: after the spinning is ended, the workblank 3 is lifted by the pneumatic jack cylinder 5 to be removed from the mandrel; when lifted to an appropriate position, the workblank 3 is completely removed from the mandrel, wherein a cylindrical part formed by spinning has an outer diameter of 3000 mm and a wall thickness of 30 mm.

To sum up, the hot-spinning formation method provided by the invention can be used for spinning formation of titanium alloy cylindrical parts with an outer diameter over 3 m, the obtained cylindrical parts have good straightness and roundness, and the yield is high; and a vertical spinning lathe is used for spinning, the mandrel 2 is easy to change, the workblank 3 is easy to assemble and disassemble, and the use requirements of titanium cylinders on the surface of large-diameter high-end raw foil cathode rollers are met.

The above embodiments are merely specific embodiments of the invention, which are provided to help those skilled in the art understand or implement the invention. It is obvious to those skilled in the art to make various modifications of these embodiments. The general principle defined in this specification can be implemented in other embodiments without departing from the spirit or scope of the invention.

It should be understood that the invention is not limited to the above description, and various modifications and changes can be made to the invention without departing from the scope of the invention. The scope of the invention is limited merely by the appended claims.

What is claimed is:

1. A hot-spinning formation method for large-diameter titanium alloy cylindrical parts, wherein a to-be-machined workblank (3) is placed in a resistance furnace to be heated to 600-650° C., and is taken out of the resistance furnace after being maintained at this temperature for 0.5-1 h; the heated workblank (3) is disposed around a mandrel (2), and spinning is started when a maximum clearance between the workblank (3) and the mandrel (2) is less than 0.5 mm; after the spinning is ended, the workblank (3) is lifted by a pneumatic jack cylinder (5) to be removed from the mandrel, and when lifted to a designated position, the workblank (3) is completely removed from the mandrel, such that a titanium alloy cylindrical part is obtained; the hot-spinning formation method specifically comprises:

Step 1: installing the mandrel (2) on a spinning lathe workbench (6);

Step 2: starting the pneumatic jack cylinder (5), and enabling the pneumatic jack cylinder (5) to return to a working position;

Step 3: placing the workblank (3) in the resistance furnace, heating the workblank (3) in the resistance furnace to 600-650° C., maintaining the workblank (3) at this temperature for 0.5-1 h, and then taking the workblank (3) out of the resistance furnace;

Step 4: disposing the heated workblank (3), which is discharged out of the resistance furnace, around the mandrel (2), and clamping a lower end of the workblank (3) in a groove in the pneumatic jack cylinder (5);

Step 5: when the heated workblank (3) shrinks to clamp the mandrel (2), starting spinning, and during the spinning process, enabling spinning rollers (4) to move downwards;

Step 6: according to different passes of the spinning, repeating Step 5 in each pass of the spinning; and Step 7: when the spinning is ended, lifting, by the pneumatic jack cylinder (5), the workblank (3) to be removed from the mandrel, and when the workblank (3) is lifted to the designated position, completely removing the workblank (3) from the mandrel, such that the titanium alloy cylindrical part is obtained;

a rotational speed of the mandrel (2) is 20-40rad/min, a feed ratio is 2-4 mm/rad, and a reduction of each pass is 4-8 mm; an outer diameter of the workblank (3) is not less than 3 m.

2. The hot-spinning formation method for large-diameter titanium alloy cylindrical parts according to claim 1, wherein the workblank (3) is in transitional fit with the mandrel (2), and a clearance between the workblank (3) and the mandrel (2) is less than or equal to 0.5 mm.

3. The hot-spinning formation method for large-diameter titanium alloy cylindrical parts according to claim 1, wherein the number of the spinning rollers (4) is two, and the two spinning rollers (4) are distributed on the spinning lathe workbench (6) in a bilaterally symmetrical manner.

4. The hot-spinning formation method for large-diameter titanium alloy cylindrical parts according to claim 1, wherein a surface of the mandrel (2) is coated with a layer of molybdenum disulfide oil, water-based graphite, or a glass lubricating protectant.

5. The hot-spinning formation method for large-diameter titanium alloy cylindrical parts according to claim 1, wherein lifting rings (1) are disposed at a top end of the mandrel (2).

6. The hot-spinning formation method for large-diameter titanium alloy cylindrical parts according to claim 1, wherein the mandrel (2) is made of H13 hot work die steel, K403 high-temperature alloy, or 4Cr5MoSiV1.

7. The hot-spinning formation method for large-diameter titanium alloy cylindrical parts according to claim 1, wherein the spinning rollers (4) are made of H13 hot work die steel, W18Cr4V high-speed steel, or 4Cr5MoSiV1.

* * * * *